US012553440B2

(12) United States Patent
Ueno et al.

(10) Patent No.: US 12,553,440 B2
(45) Date of Patent: Feb. 17, 2026

(54) COMPRESSOR AND FREEZER

(71) Applicant: DAIKIN INDUSTRIES, LTD., Osaka (JP)

(72) Inventors: Hiromichi Ueno, Osaka (JP); Tatsuya Katayama, Osaka (JP); Kanetaka Miyazawa, Osaka (JP); Masaaki Adachi, Osaka (JP); Yuta Yamamoto, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/612,644

(22) Filed: Mar. 21, 2024

(65) Prior Publication Data

US 2024/0229795 A1 Jul. 11, 2024

Related U.S. Application Data

(63) Continuation of application No. PCT/JP2022/018461, filed on Apr. 21, 2022.

(30) Foreign Application Priority Data

Sep. 30, 2021 (JP) ..... 2021-161450

(51) Int. Cl.

| | |
|---|---|
| ***F04C 18/30*** | (2006.01) |
| ***F04C 29/12*** | (2006.01) |
| *F04C 18/348* | (2006.01) |
| *F04C 18/356* | (2006.01) |
| *F25B 31/02* | (2006.01) |

(52) U.S. Cl.

CPC ..... *F04C 29/128* (2013.01); *F04C 18/348* (2013.01); *F04C 18/3562* (2013.01); *F25B 31/026* (2013.01)

(58) Field of Classification Search

CPC ..... F04C 18/30; F04C 29/128; F04B 39/1073

See application file for complete search history.

(56) References Cited

U.S. PATENT DOCUMENTS

2015/0211508 A1 7/2015 Hori et al.

FOREIGN PATENT DOCUMENTS

JP 2008-101503 A 1/1999

OTHER PUBLICATIONS

International Search Report of corresponding PCT Application No. PCT/JP2022/018461 dated Jun. 21, 2022.

European Search Report of corresponding EP Application No. 22 87 5435.4 dated Sep. 17, 2024.

International Preliminary Report of corresponding PCT Application No. PCT/JP2022/018461 dated Apr. 11, 2024.

*Primary Examiner* — Paul J Gray

(74) *Attorney, Agent, or Firm* — Spencer Fane LLP

(57) ABSTRACT

A compressor includes fixed and movable members with a discharge port penetrating the fixed member and a discharge valve body to open and close the discharge port. An inflow end of the discharge port has a hydraulic diameter Di=4×(Ai/Li), where Ai is an area of the inflow end and Li is a circumferential length at the inflow end. An outlet flow path is formed between an outflow end of the discharge port and the valve body. The outlet flow path has a cross-sectional area Ao=Lo×ho, and a hydraulic diameter Do=4×{Ao/(Lo+Lv)}, where Lo is a circumferential length at the outflow end, ho is a reference lift amount of the valve body, and Lv is a circumferential length of a valve head of the valve body in contact with the outflow end. A ratio Do/Di at the inflow end is 0.602 to 0.740.

8 Claims, 18 Drawing Sheets

FIG.10

| | EXAMPLE | COMPARATIVE EXAMPLE |
|---|---|---|
| REFERENCE LIFT AMOUNT ho (mm) | 2.0 | 1.2 |
| DIAMETER di (mm) AT INFLOW END OF DISCHARGE PORT | 6 | 6 |
| DIAMETER do (mm) AT OUTFLOW END OF DISCHARGE PORT | 7.3 | 7.3 |
| DIAMETER dv (mm) OF VALVE HEAD | 8.5 | 8.5 |
| CROSS-SECTIONAL AREA Ao ($mm^2$) OF OUTLET FLOW PATH | 45.9 | 27.5 |
| HYDRAULIC DIAMETER Di AT INFLOW END OF DISCHARGE PORT | 6 | 6 |
| HYDRAULIC DIAMETER Do OF OUTLET FLOW PATH | 3.7 | 2.2 |
| HYDRAULIC DIAMETER RATIO Do/Di | 0.616 | 0.370 |
| DIAMETER dv OF VALVE HEAD/REFERENCE LIFT AMOUNT ho | 4.25 | 7.08 |

COMPRESSOR AND FREEZER

CROSS-REFERENCE TO RELATED APPLICATIONS

This is a continuation of International Application No. PCT/JP2022/018461 filed on Apr. 21, 2022, which claims priority to Japanese Patent Application No. 2021-161450, filed on Sep. 30, 2021. The entire disclosures of these applications are incorporated by reference herein.

BACKGROUND

Technical Field

The present disclosure relates to a compressor and a refrigeration apparatus.

Background Art

A typically known compressor includes a discharge valve for opening and closing a discharge port. For example, Japanese Unexamined Patent Publication No. 2008-101503 discloses a rotary compressor including what is called a "reed valve" as a discharge valve.

The rotary compressor according to Japanese Unexamined Patent Publication No. 2008-101503 includes the discharge valve at a main bearing. This discharge valve includes a plate-shaped valve body to cover the outflow end of the discharge port. While the internal pressure of a compression chamber is lower than the back pressure of the valve body, the valve body closes the discharge port to reduce the backflow of a fluid into the compression chamber. On the other hand, when the internal pressure of the compression chamber becomes higher than the back pressure of the valve body, the valve body is elastically deformed and apart from the outflow end of the discharge port. Accordingly, a high-pressure fluid in the compression chamber flows out through a gap between the outflow end of the discharge port and the valve body.

SUMMARY

A first aspect of the present disclosure is directed to a compressor including a fixed member that forms a compression chamber, and a movable member driven to rotate and change a volume of the compression chamber. The compressor is configured to suck a fluid into the compression chamber and compress the fluid. The fixed member includes a discharge port penetrating the fixed member to lead the fluid out of the compression chamber, and a discharge valve configured to open and close the discharge port. The discharge valve includes a valve body configured to close the discharge port by covering an outflow end of the discharge port, and to open the discharge port by floating from the outflow end of the discharge port.

An inflow end of the discharge port has a hydraulic diameter Di expressed by $Di=4\times(Ai/Li)$, where Ai is an area of the inflow end and Li is a circumferential length at the inflow end. An outlet flow path is formed between the outflow end of the discharge port and the valve body. The outlet flow path has a cross-sectional area Ao expressed by $Ao=Lo\times ho$, and a hydraulic diameter Do expressed by $Do=4\times\{Ao/(Lo+Lv)\}$, where Lo is a circumferential length at the outflow end of the discharge port, ho is a reference lift amount of the valve body, and Lv is a circumferential length of a valve head. The valve head is a portion of the valve body in contact with the outflow end of the discharge port. A ratio Do/Di of the hydraulic diameter Do of the outlet flow path to the hydraulic diameter Di at the inflow end of the discharge port is 0.602 to 0.740.

BRIEF DESCRIPTION OF THE DRAWINGS

FIG. 10 is a table showing hydraulic diameter ratios Do/Di and other parameters with respect to the reference lift amounts ho according to an example and a comparative example.

DETAILED DESCRIPTION OF EMBODIMENT(S)

Figure 1:
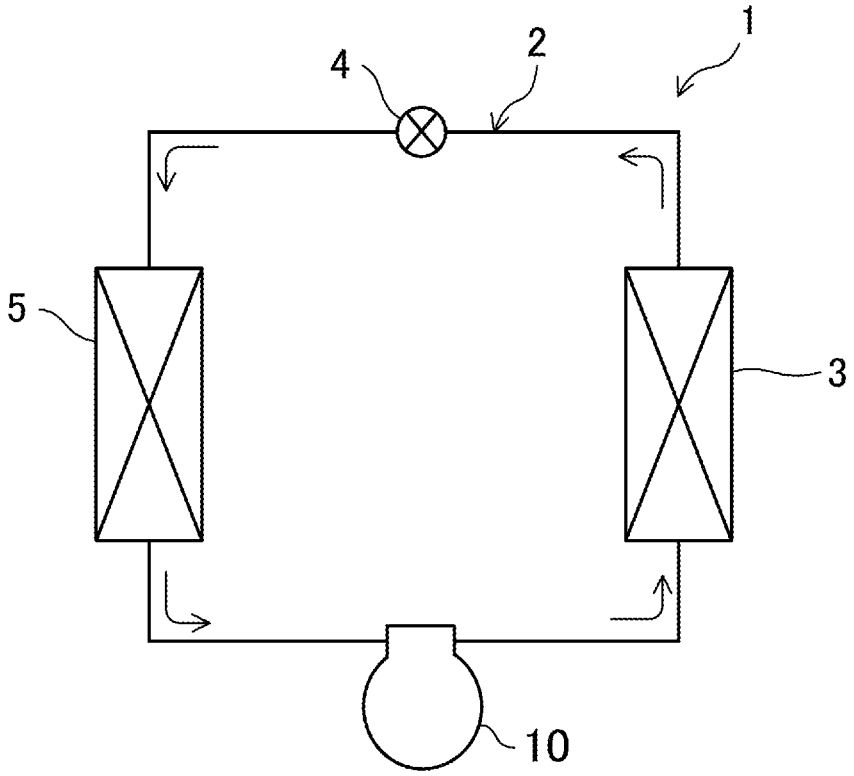
FIG. 1 is a schematic configuration diagram of a refrigerant circuit included in a refrigeration apparatus according to an embodiment.

An illustrative embodiment will be described below in detail with reference to the drawings. The expressions of "first," "second," "third," . . . in the following embodiment are used to distinguish the words to which these expressions are given, and the number and order of the words are not limited. The drawings are used for conceptual description of the present disclosure. In the drawings, dimensions, ratios, or numbers may be exaggerated or simplified for easier understanding of the technique of the present disclosure.

The compressor (10) according to this embodiment is provided in a refrigeration apparatus (1).

Refrigeration Apparatus

As illustrated in FIG. 1, the refrigeration apparatus (1) includes a refrigerant circuit (2) filled with a refrigerant. The refrigerant circuit (2) includes the compressor (10), a radiator (3), a decompression mechanism (4), and an evaporator (5). The decompression mechanism (4) is an expansion valve, for example. The refrigerant circuit (2) circulates the refrigerant to perform a vapor compression refrigeration cycle.

In the refrigeration cycle, the gas refrigerant compressed by the compressor (10) dissipates heat to the air in the radiator (3). At this time, the refrigerant is liquefied and changed into a liquid refrigerant. The liquid refrigerant having dissipated heat is decompressed by the decompression mechanism (4). The decompressed liquid refrigerant is evaporated in the evaporator (5). At this time, the refrigerant is vaporized and changed into a gas refrigerant. The evaporated gas refrigerant is sucked into the compressor (10). The compressor (10) compresses the sucked gas refrigerant. The refrigerant is an example of the fluid.

The refrigeration apparatus (1) is an air conditioner, for example. The air conditioner may be a cooling and heating machine that switches between cooling and heating. In this case, the refrigerant circuit (2) has a switching mechanism for switching the direction of circulation of the refrigerant. The switching mechanism is a four-way switching valve, for example. The air conditioner may be a machine dedicated to cooling or a machine dedicated to heating.

The refrigeration apparatus (1) may be a water heater, a chiller unit, or a cooling apparatus configured to cool air in an internal space. The cooling apparatus is for cooling the air inside a refrigerator, a freezer, or a container, for example.

Compressor

Figure 2:
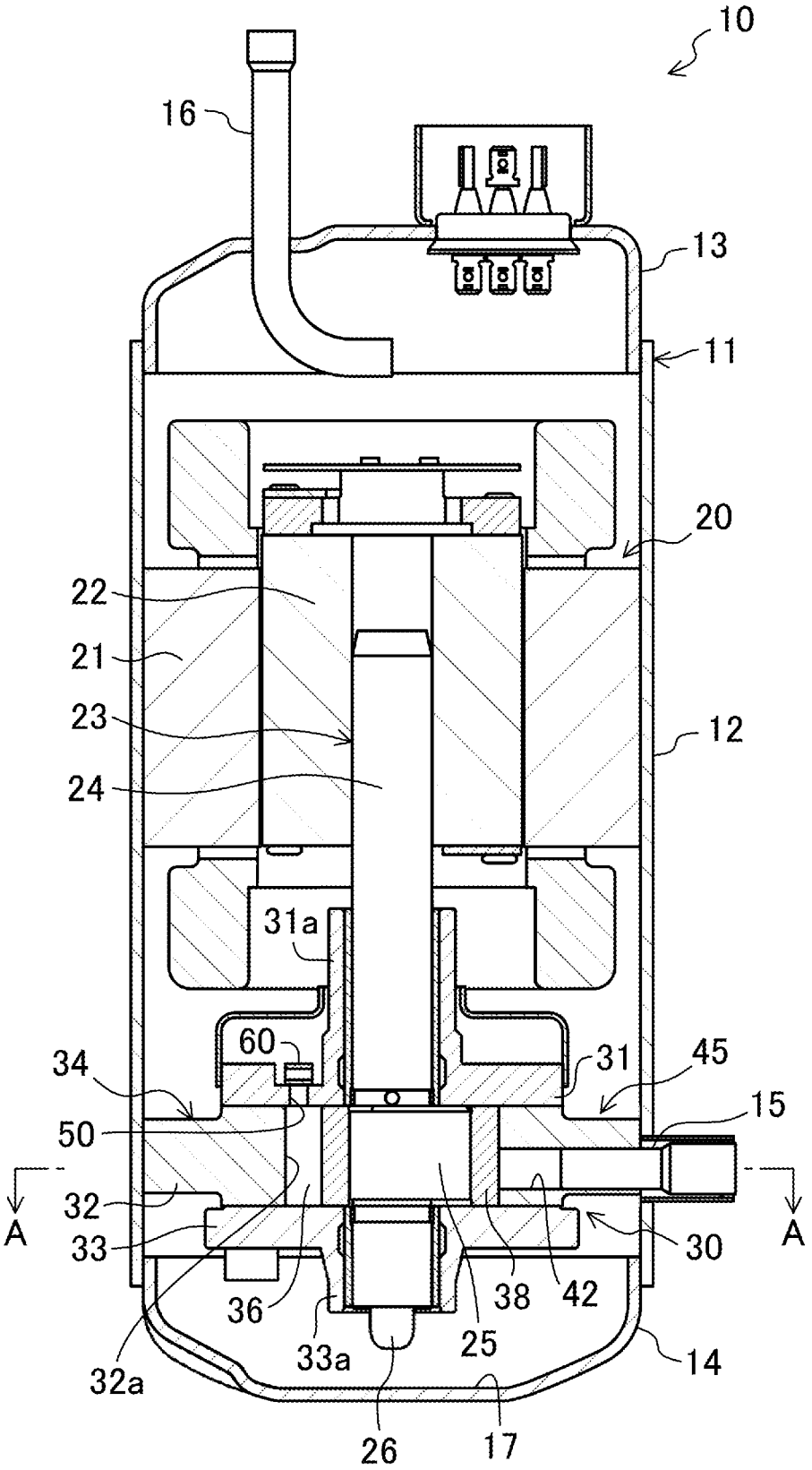
FIG. 2 is a longitudinal cross-sectional view of a compressor according to the embodiment.

As illustrated in FIG. 2, the compressor (10) according to this example is a hermetic rotary compressor. The compressor has a maximum number of revolutions of 118 rps or more. The maximum number of revolutions defines a maximum value of the number of revolutions of an electric motor (20). It is preferable to increase the maximum number of revolutions of the compressor (10) in order to increase the amount of circulation of the refrigerant in the refrigerant circuit (2) and ensure the maximum amount of circulation of the refrigerant. This is advantageous in increasing the cooling capacity in a cooling operation and the heating capacity in a heating operation of the air conditioner.

The compressor (10) includes a casing (11), the electric motor (20), and a compression mechanism (30). The electric motor (20) and the compression mechanism (30) are housed in the casing (11). The compression mechanism (30) is disposed in a lower part of the casing (11). The electric motor (20) is disposed above the compression mechanism (30).

Casing

The casing (11) is a cylindrical closed container with both ends closed. The casing (11) is placed in an upright position. The casing (11) includes a barrel (12), an upper end plate (13), and a lower end plate (14). The barrel (12) is in a cylindrical shape. The upper end plate (13) closes the upper end opening of the barrel (12). The lower end plate (14) closes the lower end opening of the barrel (12).

A suction pipe (15) is attached to a lower portion of the barrel (12). The suction pipe (15) penetrates the barrel (12) of the casing (11) and is connected to the compression mechanism (30). A discharge pipe (16) is attached to the upper end plate (13). The discharge pipe (16) penetrates the upper end plate (13) and opens to a space above the electric motor (20) in the casing (11). The casing (11) includes an oil reservoir (17) at the bottom thereof. The oil reservoir (17) stores a lubricant.

Electric Motor

The electric motor (20) includes a stator (21), a rotor (22), and a drive shaft (23). The stator (21) and the rotor (22) are each in a cylindrical shape. The stator (21) is fixed to the barrel (12) of the casing (11). The rotor (22) is placed in the hollow of the stator (21). The drive shaft (23) is inserted into the hollow of the rotor (22). The rotor (22) is fixed to the drive shaft (23) and rotates integrally with the drive shaft (23).

The drive shaft (23) is a rod-shaped member extending in the top-down direction. The drive shaft (23) has a main shaft portion (24) and an eccentric portion (25). The eccentric portion (25) is closer to the lower end of the main shaft portion (24). The eccentric portion (25) has a larger diameter than the main shaft portion (24). The eccentric portion (25) has an axis eccentric to the axis of the main shaft portion (24). Although not shown, an oil supply passage is formed in the drive shaft (23). The oil supply passage is used for supplying the lubricant to a sliding portion of the compressor (10).

A pump (26) is provided at a lower end portion of the main shaft portion (24). The pump (26) is immersed in the lubricant in the oil reservoir (17). When the drive shaft (23) rotates, the lubricant in the oil reservoir (17) is pumped up to the oil supply passage of the drive shaft (23) by the pump (26). The pumped lubricant is supplied through the oil supply passage to the sliding portions of the compressor (10), such as the compression mechanism (30), a first bearing (31*a*), and a second bearing (33*a*).

Compression Mechanism

The compression mechanism (30) is what is called an "oscillating-piston, rotary fluid machine." The compression mechanism (30) includes a front head (31), a cylinder (32), a rear head (33), a piston (38), and a pair of bushes (41). The front head (31), the cylinder (32), and the rear head (33) are fastened to each other with bolts so as to form a housing (34). The housing (34) is an example of a fixed member. The piston (38) is an example of a movable member.

The front head (31) is a member that closes the upper end surface of the cylinder (32). The first bearing (31*a*) is provided at a central portion of the front head (31). The first bearing (31*a*) is in a tubular shape and protrudes upward. The first bearing (31*a*) functions as a sliding bearing. The drive shaft (23) is inserted into the hollow of the first bearing (31*a*). The first bearing (31*a*) is located above the eccentric portion (25) of the drive shaft (23), and rotatably supports the main shaft portion (24).

The rear head (33) is a member that closes the lower end surface of the cylinder (32). The second bearing (33*a*) is provided at a central portion of the rear head (33). The second bearing (33*a*) is in a tubular shape and protrudes downward. The second bearing (33*a*) functions a sliding bearing. The drive shaft (23) is inserted into the hollow of the second bearing (33*a*). The second bearing (33*a*) is located below the eccentric portion (25) of the drive shaft (23), and rotatably supports the main shaft portion (24).

The cylinder (32) is a thick disk-shaped member. The cylinder (32) includes a cylinder bore (32*a*) at a central portion thereof. The cylinder bore (32*a*) is a circular hole that penetrates the cylinder (32) in the thickness direction. The cylinder bore (32*a*) is a closed space separated by the front head (31) and the rear head (33). The housing (34) forms a compression chamber (36), together with the piston (38) housed in the cylinder bore (32*a*). The cylinder (32) is fixed to the barrel (12) of the casing (11) with the centerline of the cylinder bore (32*a*) extending in the top-down direction.

Figure 3:
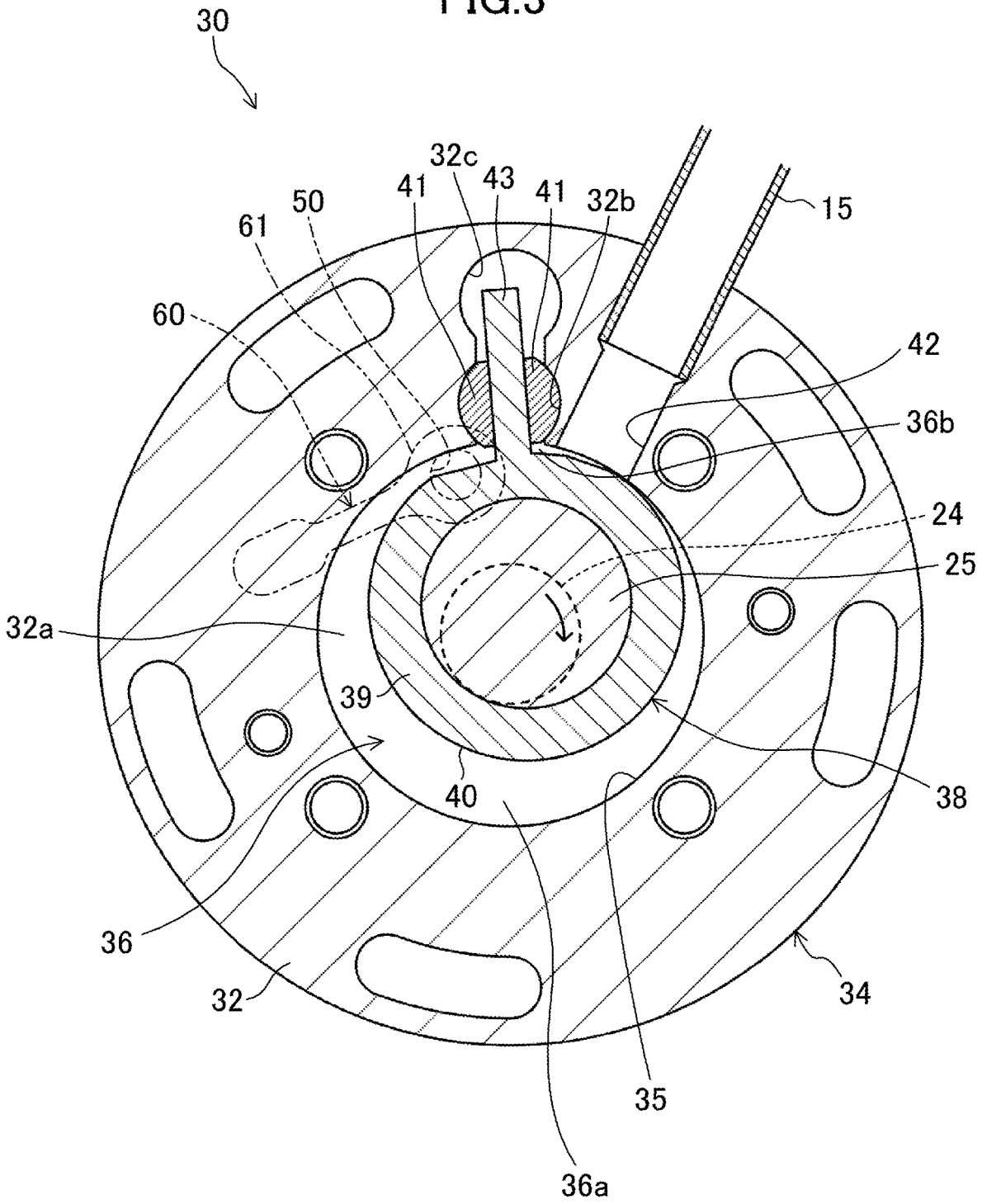
FIG. 3 is a cross-sectional view of a compression mechanism taken along the line A-A in FIG. 2.

As illustrated in FIG. 3, the cylinder (32) has a bush hole (32*b*) and a blade hole (32*c*). The bush hole (32*b*) and the blade hole (32*c*) penetrate the cylinder (32) in the thickness direction. The bush hole (32*b*) and the blade hole (32*c*) are each substantially in a circular shape. The bush hole (32*b*) is open to the compression chamber (36). The blade hole (32*c*) communicates with the bush hole (32*b*). The bush hole (32*b*) is located between the compression chamber (36) and the blade hole (32*c*).

The pair of bushes (41) are fitted into the bush hole (32*b*). Each bush (41) is a semi-cylindrical member. The flat surfaces of the pair of bushes (41) face each other with a space therebetween. The pair of bushes (41) can oscillate about the centerline of the bush hole (32*b*). The pair of bushes (41) sandwich a blade (43), which will be described later, and restrict the rotation of the piston (38) on its own axis.

The piston (38) includes a roller (39) and the blade (43). The roller (39) is a cylindrical member. The eccentric portion (25) of the drive shaft (23) is rotatably fitted in the hollow of the roller (39). The outer circumferential surface (40) of the roller (39) is in sliding contact with the inner circumferential surface (35) of the cylinder (32). The compression chamber (36) is defined by the outer circumferential surface (40) of the roller (39) and the inner circumferential surface (35) of the cylinder (32). The compression chamber (36) serves as a space for compressing a gas refrigerant.

The blade (43) is in the shape of a flat plate. The blade (43) is provided on the outer circumferential surface (40) of the roller (39) and extends outward in the radial direction of the roller (39). The blade (43) partitions the compression chamber (36) into a high-pressure chamber (36*a*) and a low-pressure chamber (36*b*). The blade (43) is sandwiched between the pair of bushes (41) so as to be movable back and forth and is inserted into the blade hole (32*c*). The blade (43) is supported by the cylinder (32) via the pair of bushes (41).

The cylinder (32) has a suction port (42). The suction port (42) penetrates the cylinder (32) in the radial direction and communicates with the low-pressure chamber (36*b*) of the compression chamber (36). The suction port (42) has one end open to the inner circumferential surface (35) of the cylinder (32). The opening end of the suction port (42) on the inner circumferential surface (35) of the cylinder (32) is adjacent to the bushes (41) (on the right of the bushes (41) in FIG. 3). On the other hand, the suction port (42) has the other end into which the suction pipe (15) is inserted.

The front head (31) has a discharge port (50). The discharge port (50) penetrates the front head (31) and communicates with the high-pressure chamber (36*a*) of the compression chamber (36). The discharge port (50) is a port for leading the gas refrigerant out of the compression chamber (36). On the lower surface of the front head (31), the opening end of the discharge port (50) is located opposite to the suction port (42) with respect to the bushes (41) (on the left of the bushes (41) in FIG. 3). The detailed shape of the discharge port (50) will be described later.

The compressor (10) sucks a low-pressure gas refrigerant into the compression chamber (36) from the suction pipe (15) through the suction port (42). The piston (38) is driven to rotate by the electric motor (20) to change the volume of the compression chamber (36) (i.e., the high-pressure chamber (36*a*) and the low-pressure chamber (36*b*)). The gas refrigerant sucked into the compression chamber (36) is compressed accordingly. The compressor (10) leads the high-pressure gas refrigerant compressed in the compression chamber (36) out from the discharge port (50), and discharges the gas refrigerant from the discharge pipe (16) through the internal space of the casing (11).

Discharge Valve

Figure 4:
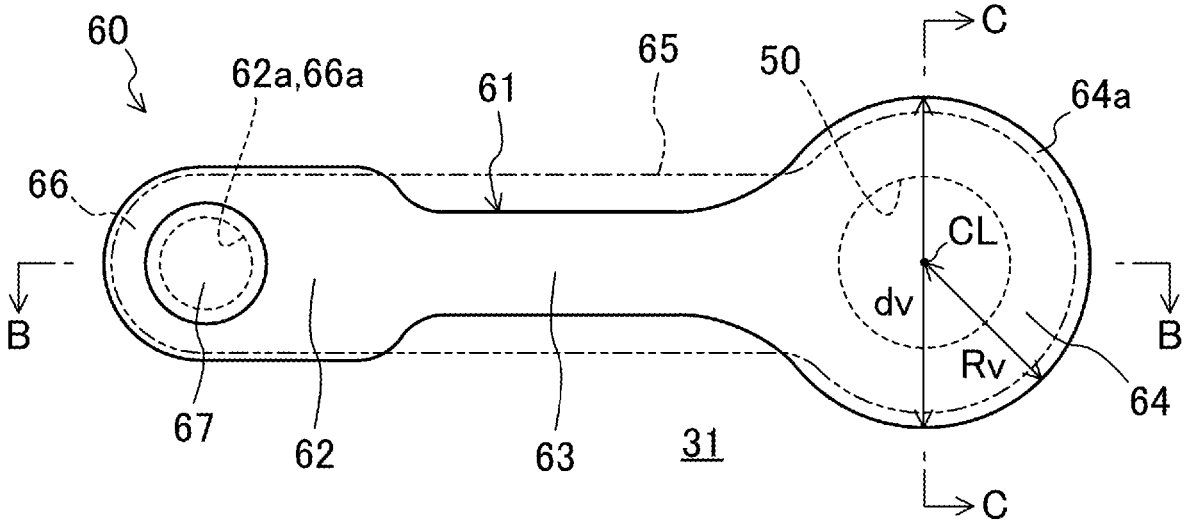
FIG. 4 is a plan view illustrating a discharge valve as an example.
Figure 5A:
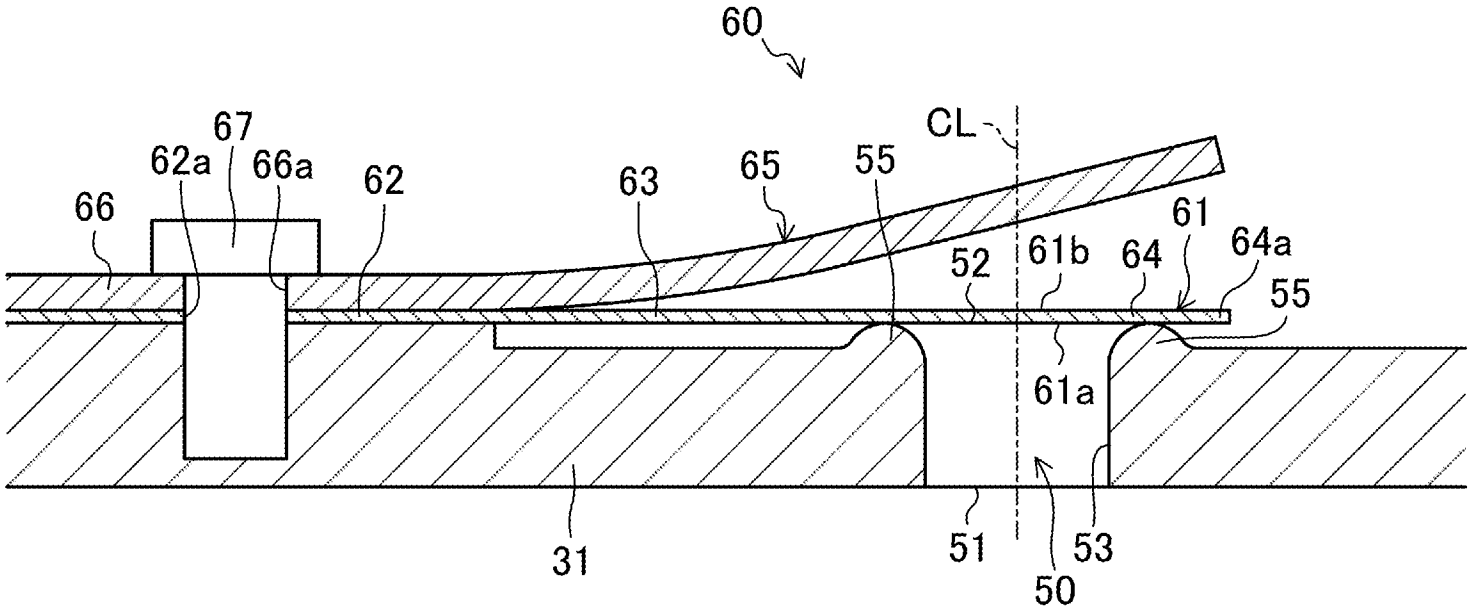
FIG. 5A is a cross-sectional view illustrating, as an example, a main part of the compression mechanism taken along line B-B in FIG. 4, with the discharge valve closed.
Figure 5B:
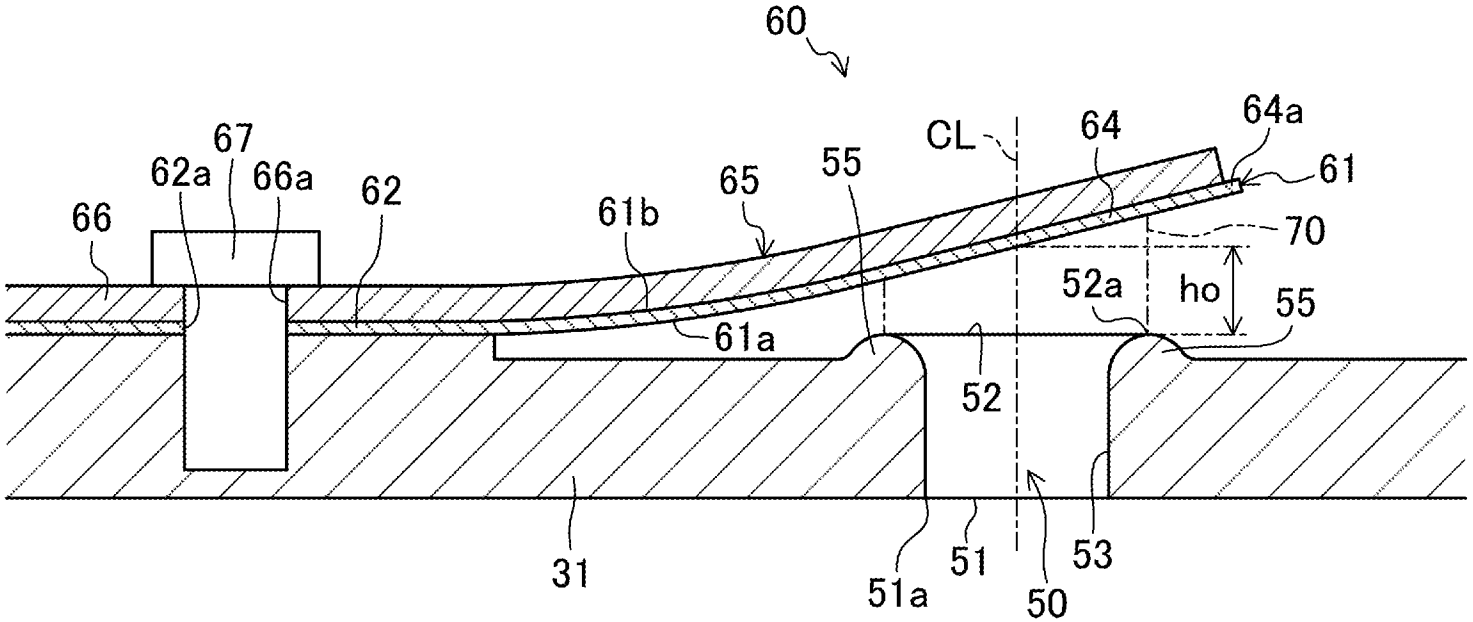
FIG. 5B is a cross-sectional view illustrating, as an example, the main part of the compression mechanism taken along line B-B in FIG. 4, with the discharge valve open.
Figure 6:
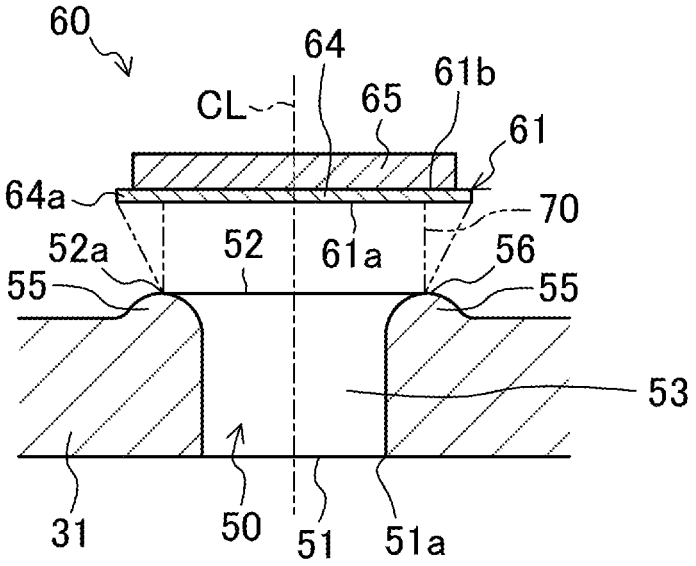
FIG. 6 is a cross-sectional view illustrating, as an example, the main part of the compression mechanism taken along line C-C in FIG. 4.

A discharge valve (60) is provided on the upper surface of the front head (31). The discharge valve (60) opens and closes the discharge port (50). The discharge valve (60) is configured by a reed valve. As illustrated in FIGS. 5A, 5B, and 6, the discharge valve (60) is attached to the upper surface of the front head (31). As is also illustrated in FIG. 4, the discharge valve (60) includes a valve body (61), a valve stopper (65), and a fixing pin (67). The proximal end (62) of the valve body (61) and the proximal end (66) of the valve stopper (65) are fixed together to the front head (31) with the fixing pin (67) such as a bolt.

The valve body (61) is a thin plate-shaped member that is elongated and flat. The valve body (61) is, for example, made of spring steel and flexible. The valve body (61) covers the outflow end (52) of the discharge port (50). The valve body (61) closes the discharge port (50) by covering the outflow end (52) of the discharge port (50), and opens the discharge port (50) by floating from the outflow end (52) of the discharge port (50). The valve body (61) includes the proximal end (62), a valve neck (63), and a valve head (64).

The proximal end (62) of the valve body (61) has a fastening hole (62*a*). The fixing pin (67) is inserted into the fastening hole (62*a*). The valve neck (63) of the valve body (61) is smaller in width than the proximal end (62) and the valve head (64). The valve head (64) forms the distal end of the valve body (61). The valve head (64) is a portion of the valve body (61) at which the valve body (61) comes into contact with the outflow end (52) of the discharge port (50). The valve head (64) is in a circular shape with a larger diameter than the outflow end (52) of the discharge port (50).

The valve stopper (65) is a metal member with high rigidity. The valve stopper (65) is in an elongated plate-like shape corresponding to the shape of the valve body (61). The proximal end (66) of the valve stopper (65) has a fastening hole (66*a*). The fixing pin (67) is inserted into the fastening hole (66*a*). The valve stopper (65) is in a shape that curves upward so that the closer it is to the distal end, the farther it is from the front head (31). The valve stopper (65) is placed to overlap with the valve body (61). The distal end of the valve stopper (65) corresponding to the valve head (64) is in a circular shape with a diameter slightly smaller than the diameter of the valve head (64).

As illustrated in FIG. 5A, the discharge port (50) is in a closed state while the valve body (61) covers the outflow end (52) of the discharge port (50). When the discharge valve (60) is in the closed state, the front surface (61*a*) of the valve head (64) of the valve body (61) is in tight contact with the circumferential edge of the outflow end (52) of the discharge port (50). On the other hand, as illustrated in FIGS. 5B and 6, the discharge port (50) is in an open state while the valve body (61) floats from the outflow end (52) of the discharge port (50). When the discharge valve (60) is the open state, an outlet flow path (70) is formed between the outflow end (52) of the discharge port (50) and the valve body (61). The gas refrigerant discharged from the discharge port (50) passes through the outlet flow path (70).

Operation of Compressor

An operation of the compressor (10) will be described with reference to FIG. 3.

Energization of the electric motor (20) causes the drive shaft (23) to rotate clockwise in FIG. 3. The rotation of the drive shaft (23) causes the piston (38) to rotate eccentrically while oscillating in the compression chamber (36) using the bushes (41) as a fulcrum. This eccentric rotation of the piston (38) causes a low-pressure gas refrigerant to be sucked through the suction port (42) into the low-pressure chamber (36*b*) of the compression chamber (36), and the gas refrigerant in the high-pressure chamber (36*a*) of the compression chamber (36) to be compressed.

Here, the gas pressure (i.e., pressure inside the dome) in the internal space of the casing (11) acts on the back surface of the valve body (61) of the discharge valve (60). Accordingly, the discharge valve (60) is in the closed state illustrated in FIG. 5A while the gas pressure in the high-pressure chamber (36*a*) is lower than the pressure inside the dome. As the piston (38) moves and the gas pressure in the high-pressure chamber (36*a*) gradually increases and exceeds the pressure inside the dome, the valve head (64) of the valve body (61) separates from the outflow end (52) of the discharge port (50). As a result, the discharge valve (60) is in the open state shown in FIG. 5B.

When the discharge valve (60) turns into the open state, the gas refrigerant in the high-pressure chamber (36*a*) passes through the discharge port (50) and then passes through the gap between the outflow end (52) of the discharge port (50) and the valve body (61) to be led out of the housing (34) in the internal space of the casing (11), that is, to the outside of the compression mechanism (30). The high-pressure gas refrigerant led out from the compression mechanism (30) is discharged through the discharge pipe (16) to the outside of the casing (11).

Shape of Discharge Port

A shape of the discharge port (50) will be described with reference to FIGS. 7 and 8.

The discharge port (50) is a through-hole extending straight. The discharge port (50) according to this example has a circular flow path cross section. The "flow path cross section" as used herein is a cross section orthogonal to the centerline (CL) of the discharge port (50). The inflow end (51) of the discharge port (50) is open to the front surface of the front head (31), that is, the surface facing the cylinder (32). The outflow end (52) of the discharge port (50) is open to the back surface of the front head (31), that is, the surface facing opposite to the cylinder (32).

On the back surface of the front head (31), a portion surrounding the outflow end (52) of the discharge port (50) forms a seat (55). The seat (55) is a portion of the upper surface of the front head (31) that is raised a step higher than the surrounding area. The seat (55) has an outer surface (upper surface) with a semicircular cross section. The top of the outer surface of the seat (55) forms a valve seat surface (56). The valve seat surface (56) is a surface where the valve head (64) of the valve body (61) abuts.

A portion of the discharge port (50) below the seat (55) forms a main passage (53). The flow path cross section of the main passage (53) is in a circular shape with a radius Ri and a diameter di expressed by di=Ri×2. The shape of the flow path cross section of the main passage (53) is uniform throughout the entire length. That is, the diameter di of the main passage (53) is the same throughout the entire length. Accordingly, the inflow end (51) of the discharge port (50) is also in a circular shape with a diameter di.

The outflow end (52) of the discharge port (50) is in a circular shape slightly larger than the inflow end (51) of the discharge port (50). The area of the outflow end (52) of the discharge port (50) is equal to the area of a portion, of the front surface (61*a*) of the valve head (64) of the valve body (61), on which the pressure of the discharge port (50) acts, that is, the pressure-receiving area. Accordingly, the larger the area of the outflow end (52) of the discharge port (50), the larger the pressure-receiving area of the valve body (61), resulting an increase in the force in the direction separating the valve body (61) from the outflow end (52) of the discharge port (50).

As the force in the direction separating the valve body (61) from the outflow end (52) of the discharge port (50) increases, the difference becomes small between the gas pressure in the compression chamber (36) and the gas pressure acting on the back surface of the valve body (61) at the time when the valve body (61) starts separating from the outflow end (52) of the discharge port (50). Thus, what is called "over-compression loss," which is a loss caused by compressing the gas refrigerant in the compression chamber (36) more than necessary, is reduced.

Lift Amount of Valve Body

A predetermined lift amount is set for the valve body (61) of the discharge valve (60). The lift amount of the valve body (61) is set to reduce the pressure loss when the gas refrigerant is discharged from the compression mechanism (30) and a delay of the valve body (61) of the discharge valve (60) in closing the outflow end (52) of the discharge port (50), that is, what is called a closing delay phenomenon of the discharge valve (60). It is therefore possible to reduce the poor efficiency of the compressor (10). In the compressor (10) according to this example, the reference lift amount ho of the valve body (61) is set based on the hydraulic diameter Di at the inflow end (51) of the discharge port (50).

Hydraulic Diameter Di at Inflow End of Discharge Port

As described above, the inflow end (51) of the discharge port (50) is in a circular shape with a radius Ri and a diameter di expressed by di=Ri×2. Accordingly, the circumferential length Li at the inflow end (51) of the discharge port (50) is expressed by the following Equation 1. The circumferential length Li at the inflow end (51) of the discharge port (50) is the length of the wetted perimeter of the inflow end (51) of the discharge port (50). The area Ai at the inflow end (51) of the discharge port (50) is expressed by the following Equation 2. Accordingly, the hydraulic diameter Di at the inflow end (51) of the discharge port (50) is expressed by the following Equation 3.

$$Li = di \times \pi \quad \text{(Equation 1)}$$

$$Ai = Ri^2 \times \pi \quad \text{(Equation 2)}$$

$$Di = 4 \times (Ai/Li) \quad \text{(Equation 3)}$$

In this example, since the inflow end (51) of the discharge port (50) is in a circular shape, the hydraulic diameter Di at the inflow end (51) of the discharge port (50) is equal to the diameter di at the inflow end (51) of the discharge port (50) (Di=di).

Reference Lift Amount of Valve Body

Figure 7:
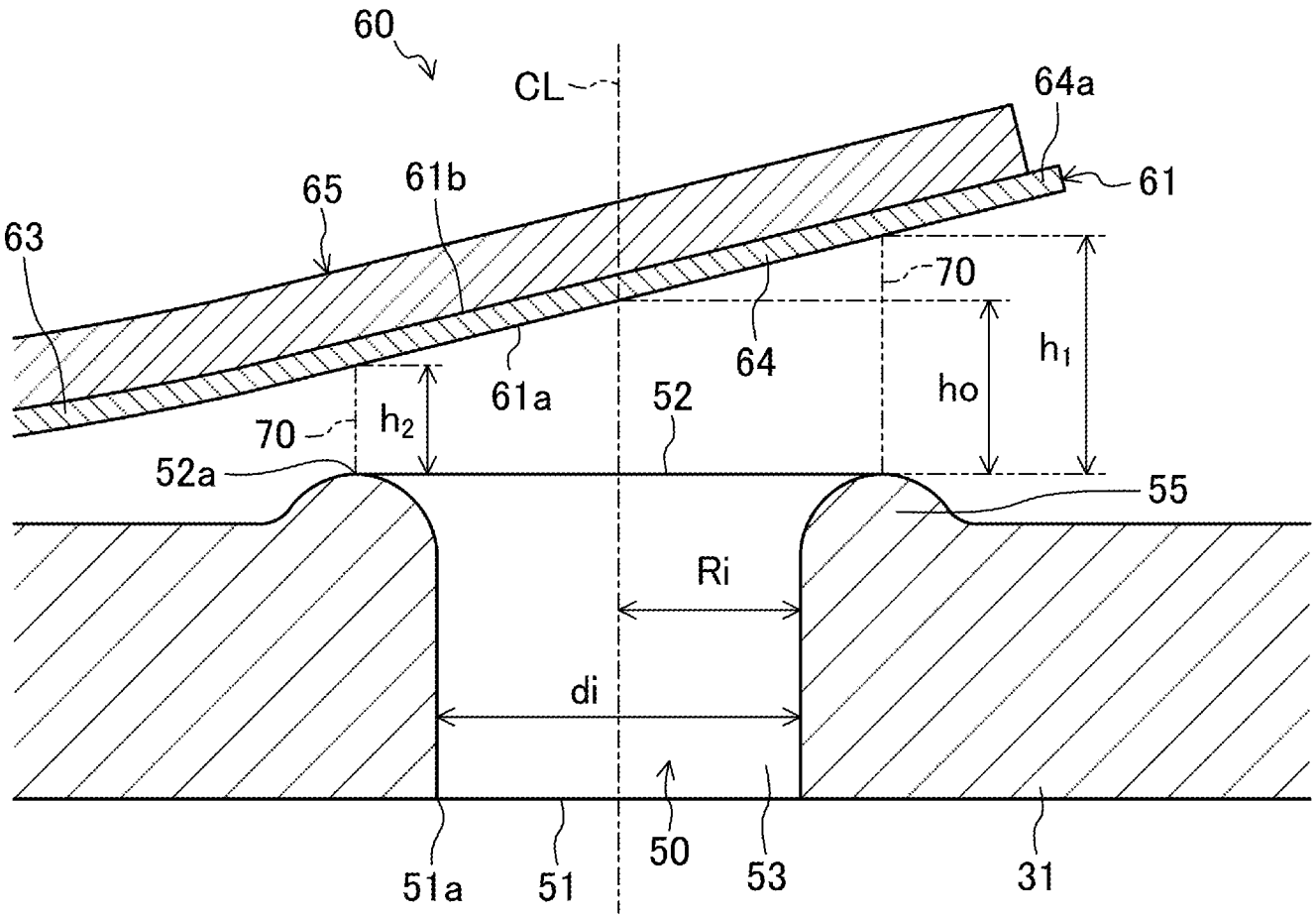
FIG. 7 is a cross-sectional view of the compression mechanism, with the main part of FIG. 5B enlarged.

As illustrated in FIG. 7, the reference lift amount ho of the valve body (61) is the maximum lift amount of the valve body (61) at the centerline (CL) of the discharge port (50). That is, the reference lift amount ho is the distance from the outflow end (52) of the discharge port (50) to the front surface (61*a*) of the valve head (64) on the centerline (CL) of the discharge port (50) in a state in which the entire back surface of the valve body (61) is in contact with the valve stopper (65). The centerline (CL) of the discharge port (50) is a straight line passing through the center of the inflow end (51) of the discharge port (50) and the center of the outflow end (52) of the discharge port (50). The centerline (CL) is orthogonal to the inflow end (51) and the outflow end (52) of the discharge port (50).

In the state in which the entire back surface of the valve body (61) is in contact with the valve stopper (65), the front surface (61*a*) of the valve head (64) is inclined with respect to the outflow end (52) of the discharge port (50) and is farther from the outflow end (52) of the discharge port (50) with a decreasing distance to the distal end of the valve body (61). Accordingly, the distance from the outflow end (52) of the discharge port (50) to the front surface (61*a*) of the valve head (64) has a maximum value $h_1$ at a portion near the distal end of the valve body (61). The distance from the outflow end (52) of the discharge port (50) to the front surface (61*a*) of the valve head (64) has a minimum value $h_2$ at a portion near the proximal end of the valve body (61).

Shape of Valve Head of Valve Body

As illustrated in FIG. 4, the valve head (64) of the valve body (61) is in a circular shape with a radius Rv and a diameter dv expressed by dv=Rv×2, which is slightly larger than the distal end of the valve stopper (65). The valve head (64) projects out from the outer circumference of the valve stopper (65) in plan view. The outer circumference of the valve head (64) forms a projecting portion (64*a*) projecting outward beyond the outflow end (52) of the discharge port (50). The length of the projecting portion (64*a*) of the valve head (64) is related to the flowability of the gas refrigerant in the outlet flow path (70) and the closing delay phenomenon of the discharge valve (60).

In the compressor (10) according to this example, the diameter dv of the valve head (64) of the valve body (61) is set based on the reference lift amount ho. The ratio (dv/ho) of the diameter dv of the valve head (64) to the reference lift amount ho of the valve body (61) is 3.5 or more and 5.2 or less. That is, the diameter dv of the valve head (64) is set to satisfy the relationship represented by the following Expression 4.

$$3.5 \leq dv/ho \leq 5.2 \quad \text{(Expression 4)}$$

The projecting portion (64*a*) of the valve head (64) provides a frictional resistance when the gas refrigerant flows through the outlet flow path (70). Accordingly, the smaller diameter dv of the valve head (64) results in the lower flow resistance of the gas refrigerant in the outlet flow path (70), allowing the gas refrigerant to flow through the outlet flow path (70) smoothly. This is advantageous for reducing the over-compression loss. In addition, the smaller the diameter dv of the valve head (64) is, the smaller the mass of the valve head (64) is. Accordingly, the inertial force accompanied with a movement of the valve head (64) caused by the opening and closing of the discharge valve (60) decreases. This is advantageous in increasing the followability of the valve body (61) and reducing the closing delay phenomenon of the discharge valve (60).

Hydraulic Diameter Do of Outlet Flow Path

Figure 8:
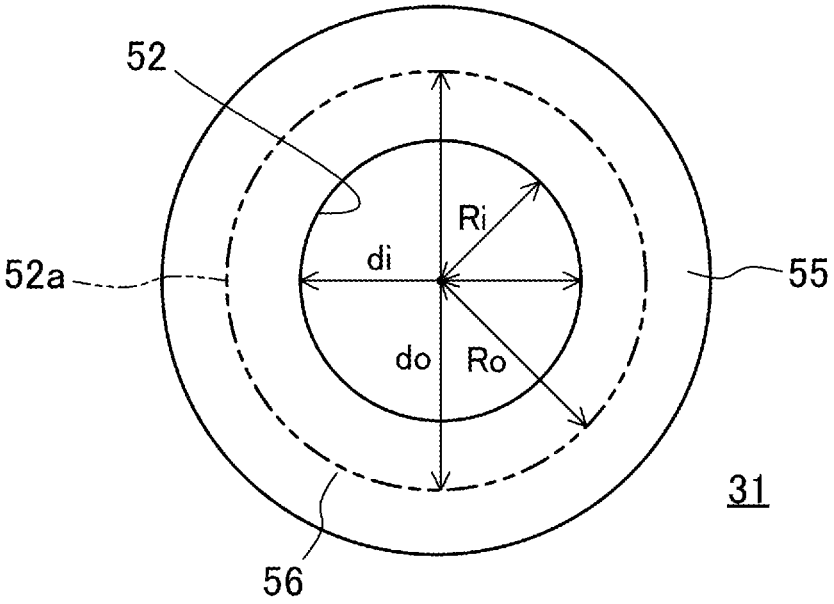
FIG. 8 is a plan view showing an outflow end of the discharge port and its periphery portion which are extracted from the upper surface of a front head.
Figure 9A:
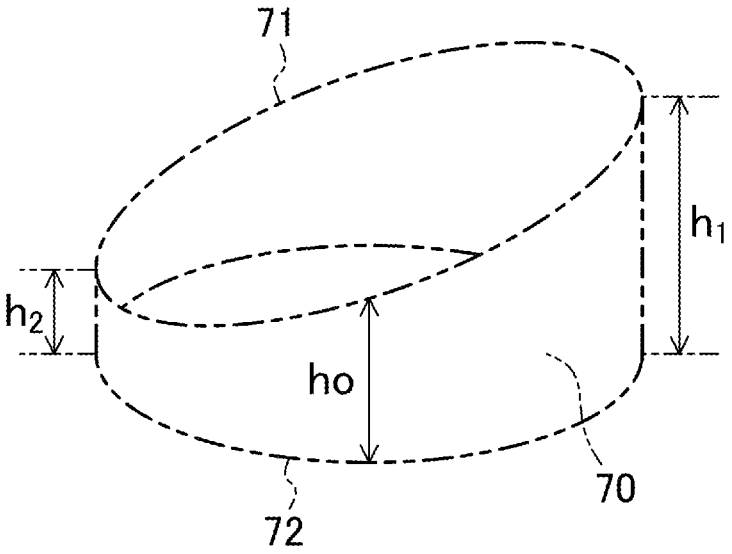
FIG. 9A is a perspective view illustrating, as an example, a shape of an actual outlet flow path.

As illustrated in FIG. 8, the outflow end (52) of the discharge port (50) is in a circular shape with a radius Ro and a diameter do. When the discharge valve (60) is in the open state, the front surface (61*a*) of the valve head (64) of the valve body (61) is inclined with respect to the outflow end (52) of the discharge port (50). Accordingly, the cross-sectional shape of the outlet flow path (70) is the same as the side view of a tubular body whose upper surface is inclined with respect to the lower surface, as illustrated in FIG. 9A.

The lower circumferential edge (72) of the outlet flow path (70) is in the same circular shape as the circumferential edge (52*a*) of the outflow end (52) of the discharge port (50). The upper circumferential edge (71) of the outlet flow path (70) is in a shape obtained by projecting the circumferential edge (52*a*) of the outflow end (52) of the discharge port (50) onto the front surface (61*a*) of the valve head (64) of the valve body (61). The height of the outlet flow path (70) is higher toward the distal end of the valve body (61). The height of the outlet flow path (70) corresponds to the distance from the outflow end (52) of the discharge port (50) to the front surface (61*a*) of the valve head (64). That is, the height of the outlet flow path (70) has a maximum value $h_1$ at the distal end of the valve body (61) and a minimum value $h_2$ at the proximal end of the valve body (61).

In the state in which the entire back surface (61*b*) of the valve body (61) is in contact with the valve stopper (65), the front surface (61*a*) of the valve head (64) is not curved and substantially flat. Accordingly, the reference lift amount ho of the valve body (61) is substantially equal to the mean value of the maximum value $h_1$ and the minimum value $h_2$ of the lift amount of the valve body (61). Thus, the flow path cross-sectional area of the actual outlet flow path (70) shown in FIG. 9A is substantially equal to the flow path cross-sectional area of the imaginary outlet flow path (75) shown in FIG. 9B.

Figure 9B:
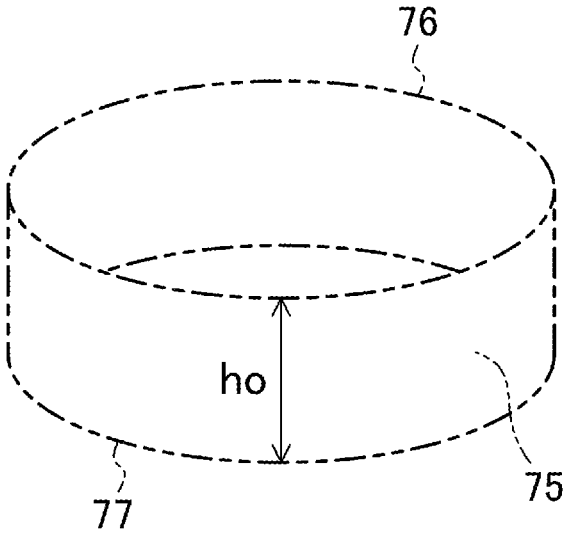
FIG. 9B is a perspective view illustrating, as an example, a shape of an imaginary outlet flow path.

The imaginary outlet flow path (75) shown in FIG. 9B is formed between the outflow end (52) of the discharge port (50) and the valve head (64) of the valve body (61), when the front surface (61*a*) of the valve head (64) is parallel to the outflow end (52) of the discharge port (50) and when the distance from the outflow end (52) of the discharge port (50) and the front surface (61*a*) of the valve head (64) is the reference lift amount ho. The cross-sectional shape of the imaginary outlet flow path (75) is the same as the side view of a cylindrical body whose upper and lower surfaces are parallel to each other.

In this example, the imaginary outlet flow path (75) shown in FIG. 9B is regarded as being substantially equivalent to the actual outlet flow path (70) shown in FIG. 9A. The hydraulic diameter Do of the actual outlet flow path (70) shown in FIG. 9A is regarded as being substantially equal to the hydraulic diameter of the imaginary outlet flow path (75) shown in FIG. 9B and calculated based on the following Equations 5 to 8.

As described above, the outflow end (52) of the discharge port (50) is in a circular shape with a radius Ri and a diameter do. The circumferential length Lo at the outflow end (52) of the discharge port (50) corresponds to the length of the wetted perimeter of the outflow end (52) of the discharge port (50). Accordingly, the circumferential length Lo at the outflow end (52) of the discharge port (50) is expressed by the following Equation 5.

$$Lo = do \times \pi \quad \text{(Equation 5)}$$

As described above, the valve head (64) of the valve body (61) has a circular outer shape with a diameter dv. Accordingly, the circumferential length Lv of the valve head (64) is expressed by the following Equation 6.

$$Lv = dv \times \pi \quad \text{(Equation 6)}$$

In the imaginary outlet flow path (75), the upper circumferential edge (76) and the lower circumferential edge (77) are in the same shape as the outflow end (52) of the discharge port (50), similarly to the lower circumferential edge of the actual outlet flow path (70). The imaginary outlet flow path (75) has a circumferential length equal to the circumferential length Lo at the outflow end (52) of the discharge port (50). Accordingly, the flow path cross-sectional area Ao of the imaginary outlet flow path (75) is expressed by the following Equation 7.

$$Ao = Lo \times ho \quad \text{(Equation 7)}$$

The length of the wetted perimeter of the imaginary outlet flow path (75) is the sum of the upper circumferential length and the lower circumferential length of the imaginary outlet flow path (75). Accordingly, the length of the wetted perimeter of the imaginary outlet flow path (75) is expressed by Lo+Lv. Accordingly, the hydraulic diameter Do of the imaginary outlet flow path (75) is expressed by the following Equation 8. In this example, the hydraulic diameter of the actual outlet flow path (70) is regarded as being equal to the hydraulic diameter Do calculated using the following Equation 8.

$$Do = 4 \times \{Ao/(Lo + Lv)\} \quad \text{(Equation 8)}$$

Hydraulic Diameter Ratio Do/Di

The hydraulic diameter ratio (Do/Di), which is the ratio of the hydraulic diameter Do of the outlet flow path (70) to the hydraulic diameter Di at the inflow end (51) of the discharge port (50), is 0.602 or more and 0.740 or less. That is, the reference lift amount of the valve body (61) is set so that the hydraulic diameter ratio (Do/Di) satisfies the relationship represented by the following Expression 9.

$$0.602 \leq Do/Di \leq 0.740 \quad \text{(Expression 9)}$$

The flow path cross-sectional area Ao of the outlet flow path (75) is Lo×ho as expressed by the above Equation 7. Accordingly, in the compressor (10) according to this example, the reference lift amount ho of the valve body (61) is set to be a value within the range represented by the following Expression 10. The lower limit value $h_{min}$ of the reference lift amount ho of the valve body (61) is expressed by the following Equation 11. The upper limit value $h_{max}$ of the reference lift amount ho of the valve body (61) is expressed by the following Equation 12.

$$h_{min} \leq ho \leq h_{max} \quad \text{(Expression 10)}$$

$$h_{min} = (0.1505 \times Di) \times (Lo + Lv)/Lo \quad \text{(Equation 11)}$$

$$h_{max} = (0.185 \times Di) \times (Lo + Lv)/Lo \quad \text{(Equation 12)}$$

FIG. 10 shows the reference lift amount ho of the valve body (61), the diameter di at the inflow end (51) of the discharge port (50), the diameter do at the outflow end (52) of the discharge port (50), the diameter dv of the valve head (64), the cross-sectional area Ao of the outlet flow path (70), the hydraulic diameter Di at the inflow end (51) of the discharge port (50), the hydraulic diameter Do of the outlet flow path(70), the hydraulic diameter ratio Do/Di, and the ratio dv/ho of the diameter of the valve head (64) to the reference lift amount ho of the valve body (61), for each of the cases where the reference lift amount ho is 2.0 mm and 1.2 mm. In the case in which the reference lift amount ho is 2.0 mm, the hydraulic diameter ratio Do/Di is 0.616, which is an example of the present disclosure. On the other hand, in the case in which the reference lift amount ho of the valve body (61) is 1.2 mm, the hydraulic diameter ratio Do/Di is 0.370, which is a comparative example different from the example of the present disclosure.

The value of the hydraulic diameter ratio Do/Di shown in FIG. 10 is calculated using the following Equation 13. The Equation 13 is a mathematical expression obtained by substituting the above Equations 1 to 3 and Equations 5 to 8 into Do/Di.

$$Do/Di = 4 \times do \times ho/\{di \times (do + dv)\} \quad \text{(Equation 13)}$$

Numerical Range of Hydraulic Diameter Ratio Do/Di

Next, the reason why setting the hydraulic diameter ratio Do/Di to be 0.602 or more and 0.740 or less is preferred will be described.

Figure 12B:
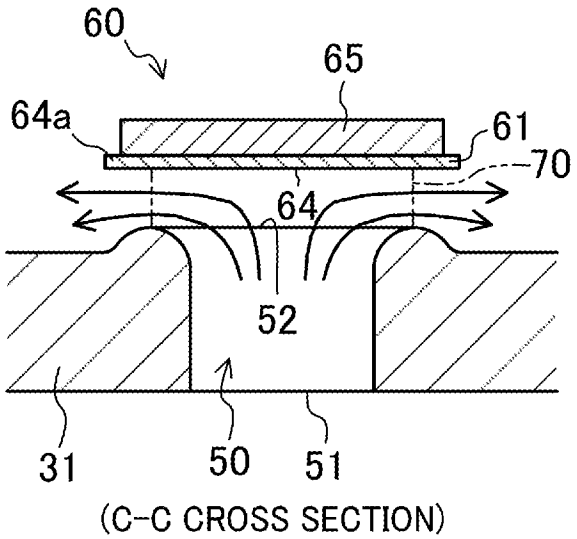
FIG. 12A and FIG. 12B include cross-sectional views of a main part of the front head taken along line B-B and line C-C in FIG. 4 in a case where the reference lift amount ho is 1.2 mm, showing a gas refrigerant flowing out from the discharge port.
Figure 12A:
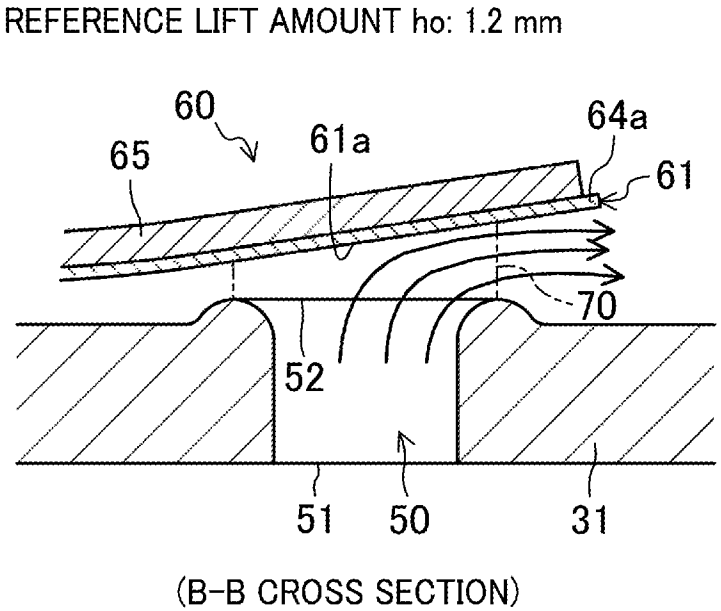

In the opening and closing of the discharge valve (60), the valve body (61) elastically deforms, so that the valve head (64) moves. The smaller the reference lift amount ho of the valve body (61), the shorter distance the valve body (61) moves, that is, the narrower the outlet flow path (70) becomes. Accordingly, if the reference lift amount ho of the valve body (61) is too small, the gas refrigerant is difficult to flow out of the compression chamber (36) smoothly. For example, in the case in which the reference lift amount ho is 1.2 mm as illustrated in FIG. 12A and FIG. 12B, the outlet flow path (70) is relatively narrow, causing greater resistance when the refrigerant gas flows out of the discharge port (50).

Figure 13:
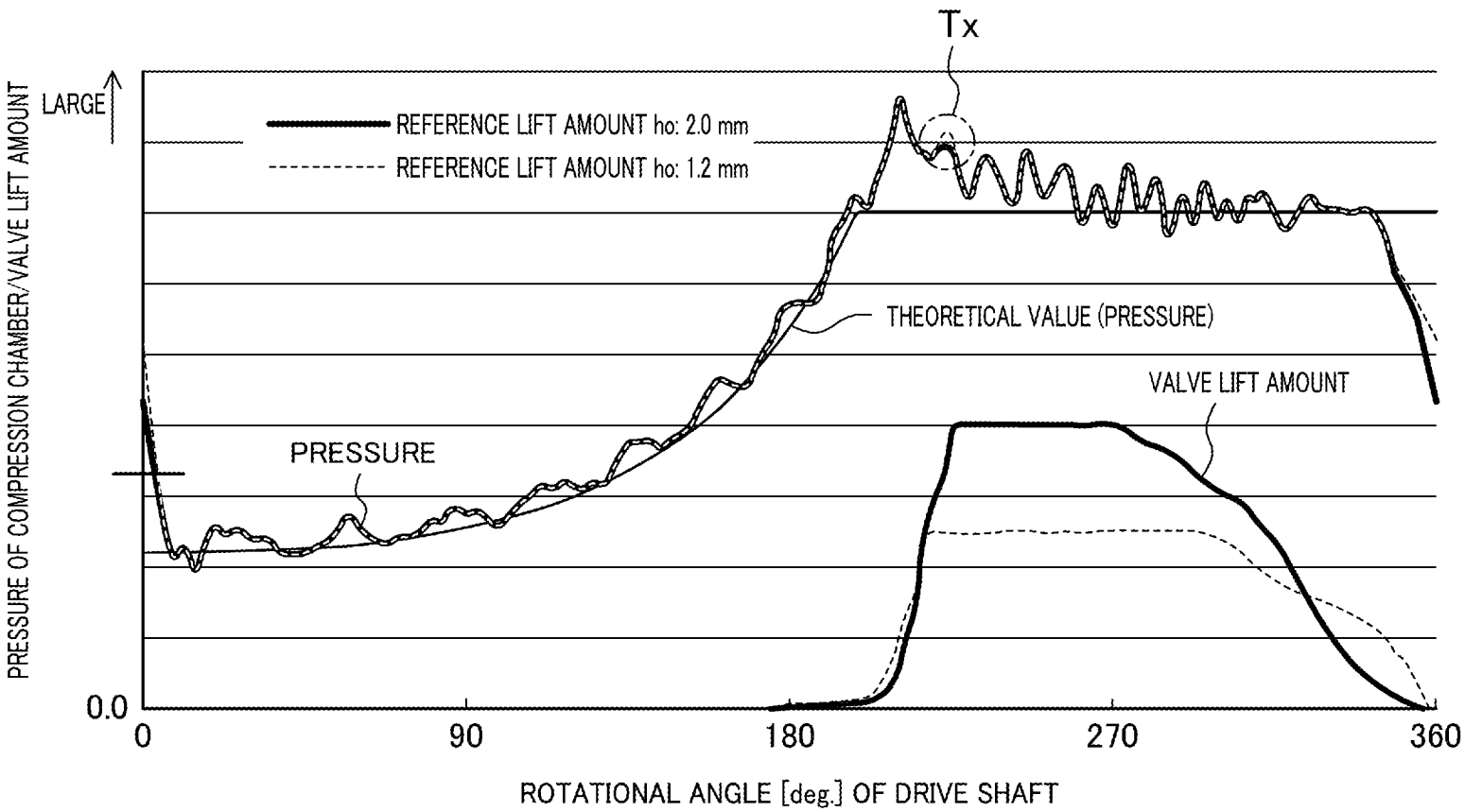
FIG. 13 is a graph of test results, showing changes in the pressure of a compression chamber and the lift amount of a valve body during one rotation of a drive shaft, in the case where a reference lift amount ho is 1.2 mm and the case where the reference lift amount ho is 2.0 mm.

If the gas refrigerant does not flow out of the compression chamber (36) smoothly, the pressure in the compression chamber (36) increases even after the valve body (61) is lifted fully, causing the over-compression in which the gas refrigerant in the compression chamber (36) is compressed more than necessary. For example, as illustrated in FIG. 13, in the case in which the reference lift amount ho is 1.2 mm, there is a situation where the pressure in the compression chamber (36) is raised a step higher at time Tx, which is a while after the valve body (61) is lifted fully. An energy loss (over-compression loss) occurs when the over-compression occurs.

In addition, if the gas refrigerant does not flow out of the compression chamber (36) smoothly, the rotational angle of the drive shaft (23) at which the valve body (61) is lifted fully widens, causing so-called a "closing delay phenomenon" in which the valve body (61) is kept in a full-lift position even at timing when the discharge valve (60) starts closing. For example, as shown in FIG. 13, the valve (61) is in the full-lift position for a while after the rotational angle of the drive shaft (23) exceeds 270° in the case where the reference lift amount ho is 1.2 mm.

If the closing delay phenomenon occurs, the closing period when the valve body (61) is closed becomes shorter, and the valve body (61) is closed rapidly at timing before the closing period ends. The seating speed of the valve head (64) of the valve body (61) on the outflow end (52) of the discharge port (50) therefore increases. If this happens, the exciting force generated when the valve body (61) abuts on the outflow end (52) of the discharge port (50) increases. As a result, the noise and vibration generated in the operation of the discharge valve (60) increase, and the impact load acting on the valve body (61) also increases.

If the closing delay phenomenon occurs, the compression chamber (36) in the initial stage of the compression phase communicates with the internal space of the casing (11) via the discharge port (50). As a result, the high-pressure gas refrigerant in the internal space of the casing (11) flows back through the discharge port (50) into the compression chamber (36). The mass flow rate of the gas refrigerant discharged from the compression mechanism (30) per unit time decreases accordingly. The efficiency of the compressor (10) therefore decreases.

In order to reduce the chances of an increase in the seating speed of the valve body (61) and a decrease in the efficiency of the compressor (10) which are caused by the closing delay phenomenon of the discharge valve (60), a larger reference lift amount ho of the valve body (61) is desirable. For this purpose, in the compressor (10) according to this example, the reference lift amount ho of the valve body (61) of the discharge valve (60) is set so that the hydraulic diameter ratio Do/Di is 0.602 or more.

However, if the reference lift amount ho of the valve body (61) of the discharge valve (60) is too large, the elastic force of the valve body (61), while the discharge valve (60) is in the open state, becomes larger than the pressure of the gas refrigerant acting on the valve body (61) before the valve body (61) is lifted fully. Accordingly, the valve body (61) is not lifted fully. In addition, the valve body (61) bends at a larger angle when the valve body (61) floats from the outflow end (52) of the discharge port (50). The bending stress on the proximal end (62) of the valve body (61) therefore increases.

In order to lift the valve body (61) fully and reduce the bending stress on the proximal end (62) of the valve body (61), a smaller reference lift amount ho of the valve body (61) is desirable. For this purpose, in the compressor (10) according to this example, the reference lift amount ho of the valve body (61) of the discharge valve (60) is set so that the hydraulic diameter ratio Do/Di is 0.740 or less.

Features of Embodiment

Figure 11B:
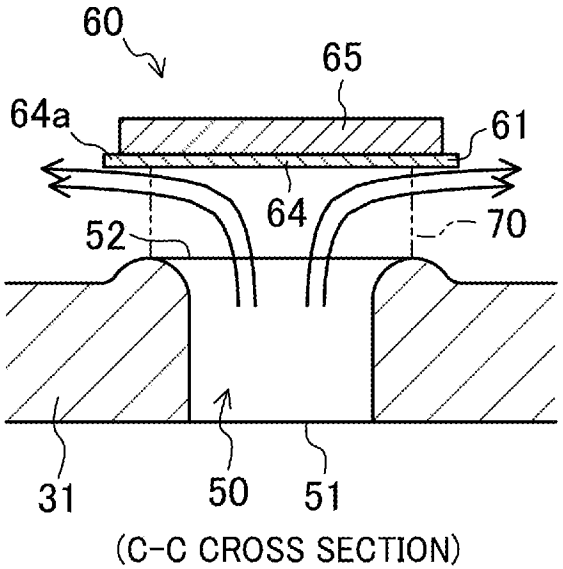
FIG. 11A and FIG. 11B include cross-sectional views of a main part of the front head taken along line B-B and line C-C in FIG. 4 in a case where the reference lift amount ho is 2.0 mm, showing a gas refrigerant flowing out from the discharge port.
Figure 11A:
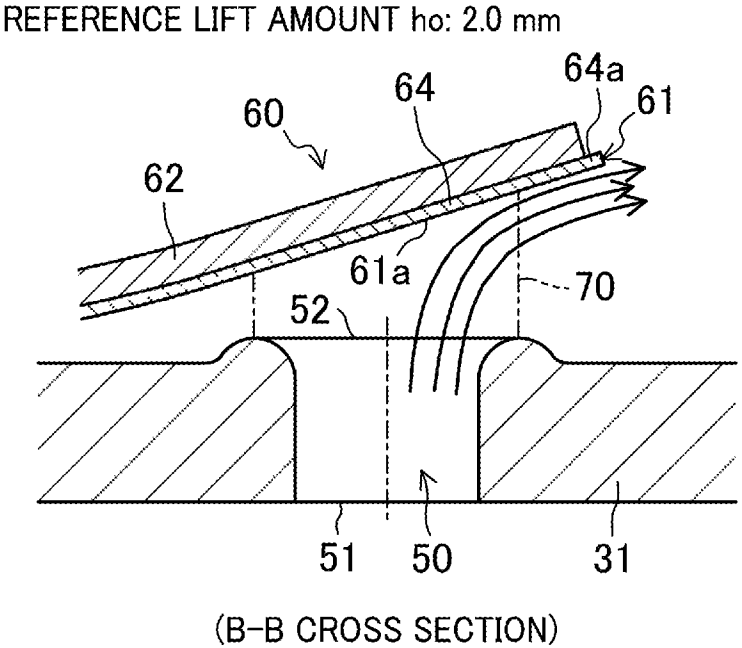

In the compressor (10) according to this embodiment, the reference lift amount ho of the valve body (61) is set with respect to the sum of the circumferential length Lo at the outflow end (52) of the discharge port (50) and the circumferential length Lv of the valve head (64) so that the ratio (Do/Di) of the hydraulic diameter Do of the outlet flow path (70) to the hydraulic diameter Di at the inflow end (51) of the discharge port (50) is 0.602 or more and 0.740 or less. The reference lift amount ho of the valve body (61) set to be this range makes the lift amount of the valve body (61) relatively large, thereby making it possible to lower the resistance generated when the refrigerant gas passes through the outlet flow path (70). For example, in the case in which the reference lift amount ho is 2.0 mm as illustrated in FIG. 11A and FIG. 11B, the outlet flow path (70) is relatively wide, which reduces the resistance when the refrigerant gas flows out of the discharge port (50).

If the resistance generated when the refrigerant gas passes through the outlet flow path (70) is low, the refrigerant gas in the compression chamber (36) is discharged quickly through the discharge port (50) to the outside in accordance with the movement of the piston (38). The smooth flow of the gas refrigerant out of the compression chamber (36) keeps the pressure in the compression chamber (36) from increasing after the valve body (61) is lifted fully, thereby making it possible to reduce over-compression. It is therefore possible to reduce the over-compression loss in the compressor (10). For example, as illustrated in FIG. 13, in the case in which the reference lift amount ho is 2.0 mm, the time Tx at which the valve body (61) is lifted fully is at the timing a while after the time Tx of the case in which the reference lift amount ho is 1.2 mm. The pressure in the compression chamber (36) at the time Tx is lower than the case in which the reference lift amount ho is 1.2 mm.

The smooth flow of the gas refrigerant out of the compression chamber (36) allows the timing when the internal pressure of the compression chamber (36) becomes lower than the back pressure of the valve body (61) to advance. It is therefore possible to reduce the closing delay phenomenon of the discharge valve (60). The closing period when the valve body (61) is closed is thus ensured, making it possible to close the valve body (61) gently at timing before the closing period ends. For example, as illustrated in FIG. 13, in the case in which the reference lift amount ho is 2.0 mm, the valve body (61) starts closing immediately after the rotational angle of the drive shaft (23) exceeds 270° and the speed of closing the valve body (61) (i.e., change in the valve lift amount) slows down before the end of the closing period. As a result, it is possible to reduce the noise and vibration generated in the operation of the discharge valve (60) and the impact load acting on the valve body (61).

The compressor (10) according to this embodiment causes less closing delay phenomenon of the discharge valve (60), thereby reducing the communication of the compression chamber (36) at the initial stage of the compression phase with the internal space of the casing (11) through the discharge port (50). It is therefore possible to reduce the high-pressure gas refrigerant in the internal space of the casing (11) flowing back through the discharge port (50) into the compression chamber (36). As a result, the efficiency of the compressor (10) increases.

In the compressor (10) according to this embodiment, the diameter dv of the valve head (64) is set so that the ratio (dv/ho) of the diameter dv of the valve head (64) to the reference lift amount ho of the valve body (61) is from 3.5 or more and 5.2 or less. The diameter dv of the valve head (64) set to be this range makes the diameter dv of the valve head (64) relatively small, thereby making it possible to lower the resistance generated when the refrigerant gas passes through the outlet flow path (70). Thus, the refrigerant gas in the compression chamber (36) can be led out quickly to the outside through the discharge port (50). This is advantageous in reducing the delay in timing at which the valve body (61) closes the outflow end (52) of the discharge port (50).

The compressor (10) according to this embodiment has a maximum number of revolutions of 118 rps or more, which is relatively high. The more the rotation speed of the compressor (10) increases, the wider the rotational angle of the drive shaft (23) at which the valve body (61) is fully lifted becomes, resulting in a delay in the timing at which the valve body (61) starts closing. Accordingly, the technique according to the present disclosure is effective in the compressor (10) that operates at a relatively large number of revolutions.

As the compressor (10) according to this embodiment, the above-mentioned compressor (10) is used in the refrigerant circuit (2). This contributes to greater efficiency of the refrigeration cycle in the refrigeration apparatus (1).

First Variation

Figure 14:
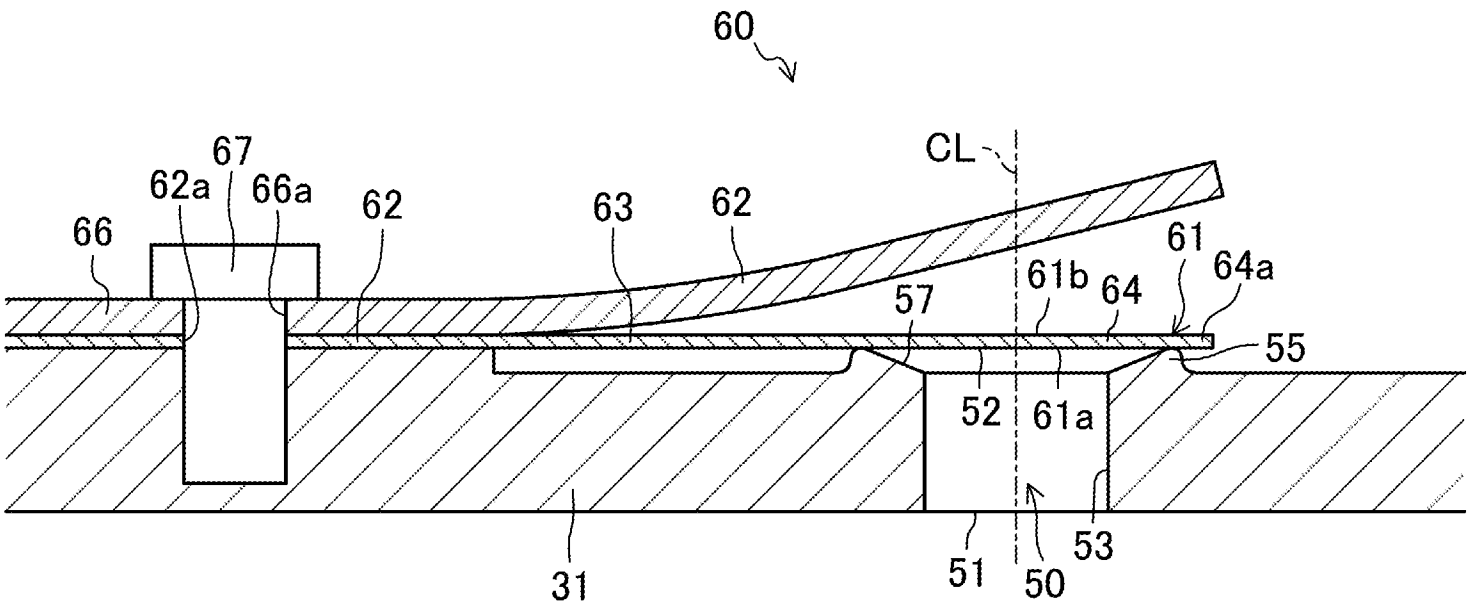
FIG. 14 is a cross-sectional view illustrating, as an example, a main part of a compression mechanism according to a first variation with a discharge valve closed, and shows a cross section corresponding to FIG. 5A.
Figure 15:
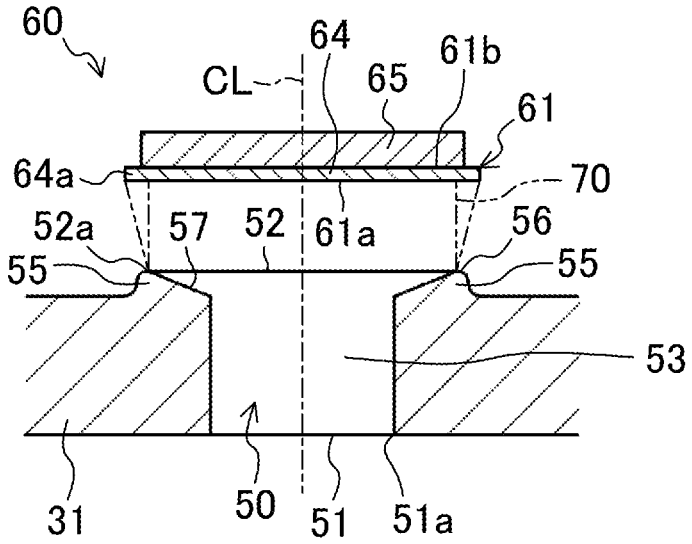
FIG. 15 is a cross-sectional view illustrating, as an example, the main part of the compression mechanism according to the first variation with the discharge valve open, and shows a cross section corresponding to FIG. 5B.

As illustrated in FIGS. 14 and 15, in the compressor (10) according to the embodiment described above, the front head (31) may have a chamfer (57) to enlarge the outflow end (52) of the discharge port (50). The outflow end (52) of the discharge port (50) has a larger area in the case with the chamfer (57) in the front head (31) than in the case without the chamfer (57). The larger area of the outflow end (52) of the discharge port (50) makes the pressure-receiving area of the valve head (64) large, resulting in an increase in the force in the direction separating the valve body (61) from the outflow end (52) of the discharge port (50).

Second Variation

Figure 16:
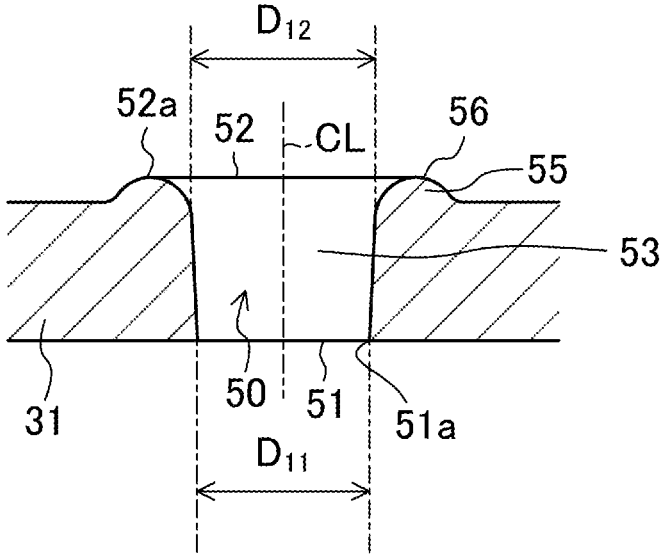
FIG. 16 is a cross-sectional view illustrating a shape of a discharge port according to a second variation, and shows a cross section corresponding to FIG. 5B.

As illustrated in FIG. 16, in the compressor (10) according to the embodiment described above, the flow path of the main passage (53) of the discharge port (50) may have a cross-sectional area that gradually increases from the inflow end (51) toward the outflow end (52) of the discharge port (50). In this example, the inner surface forming the main passage (53) of the discharge port (50) is a conical surface about the centerline (CL) of the discharge port (50). The upper end of the main passage (53) has a larger diameter than the lower end of the main passage (53).

Third Variation

Figure 17:
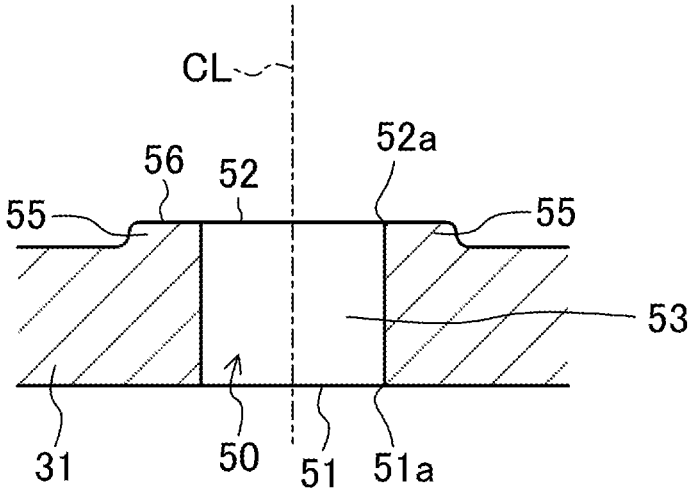
FIG. 17 is a cross-sectional view illustrating a shape of a discharge port according to a third variation, and shows a cross section corresponding to FIG. 5B.

As illustrated in FIG. 17, in the compressor (10) according to the embodiment described above, the seat (55) in the front head (31) may have a rectangular cross section. The valve seat surface (56) formed by the outer surface of the seat (55) according to this example is a flat surface. The flow path of the discharge port (50) has a circular cross-sectional shape that is uniform from the inflow end (51) to the outflow end (52) of the discharge port (50). The discharge port (50) may have a diameter increasing from the inflow end (51) toward the outflow end (52).

Fourth Variation

Figure 18:
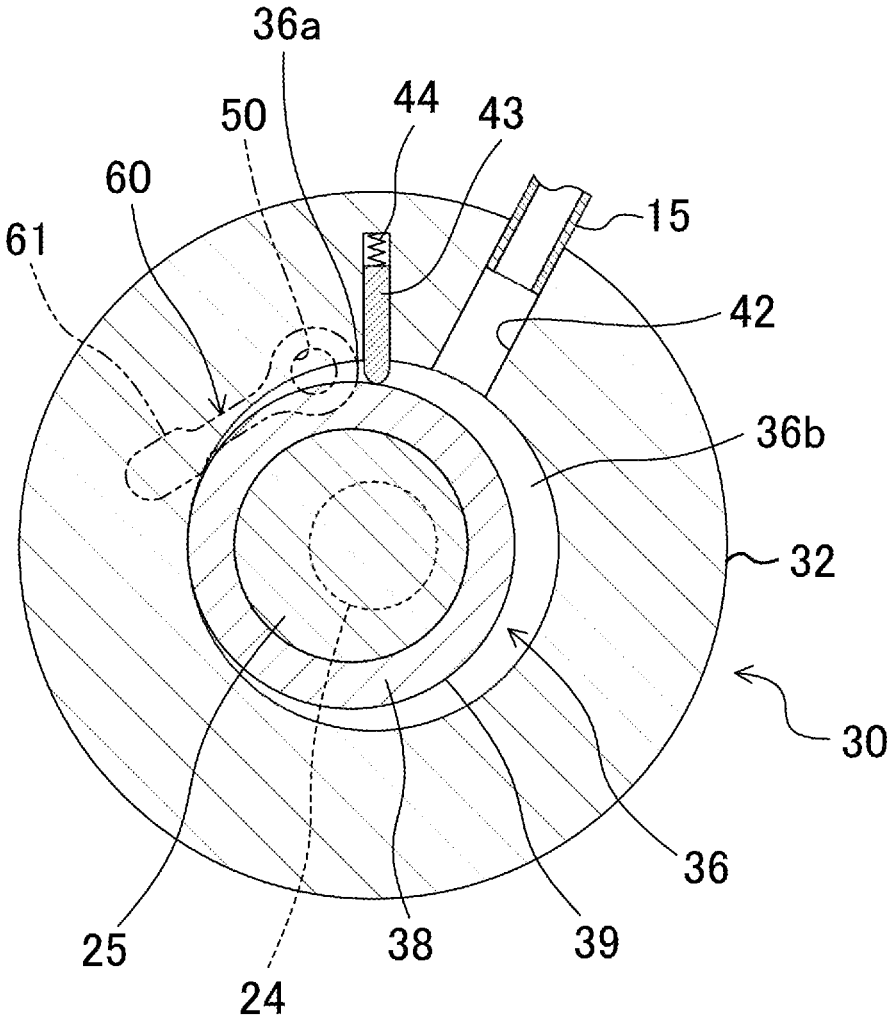
FIG. 18 is a cross-sectional view of a compression mechanism according to a fourth variation, and shows a cross section corresponding to FIG. 3.

As illustrated in FIG. 18, the compression mechanism (30) of the compressor (10) according to the embodiment described above may be a rolling piston rotary fluid machine including the blade (43) that is separate from the piston (38). In the compression mechanism (30) according to this example, the flat plate-shaped blade (43) is fitted in a blade groove extending in the radial direction of the cylinder (32) so as to be movable back and forth, and bushes (41) are omitted. The blade (43) is pressed on the outer circumferential surface (39) of the piston (38) by a spring (44). The distal end of the blade (43) is in sliding contact with the outer circumferential surface (39) of the piston (38).

Fifth Variation

In the compressor (10) according to the embodiment described above, the flow path cross section of the discharge port (50) may have a rounded rectangular shape or an oval shape. For example, the discharge port (50) is arranged such that a shorter side of the discharge port (50) is along the radial direction of the cylinder (32).

While the embodiment and variations thereof have been described above, it will be understood that various changes in form and details may be made without departing from the spirit and scope of the claims. The foregoing embodiment and variations thereof may be combined or replaced with each other without deteriorating the intended functions of the present disclosure.

As described above, the present disclosure is useful for a compressor and a refrigeration apparatus.

The invention claimed is:

1. A compressor comprising:

a fixed member that forms a compression chamber; and a movable member driven to rotate and change a volume of the compression chamber, the compressor being configured to suck a fluid into the compression chamber and compress the fluid, the fixed member including a discharge port penetrating the fixed member to lead the fluid out of the compression chamber, and a discharge valve configured to open and close the discharge port, the discharge valve including a valve body configured to close the discharge port by covering an outflow end of the discharge port, and open the discharge port by floating from the outflow end of the discharge port, an inflow end of the discharge port having a hydraulic diameter Di expressed by $Di=4\times(Ai/Li)$, where Ai is an area of the inflow end and Li is a circumferential length at the inflow end, an outlet flow path being formed between the outflow end of the discharge port and the valve body, the outlet flow path having a cross-sectional area Ao expressed by $Ao=Lo\times ho$, and a hydraulic diameter Do expressed by $Do=4\times\{Ao/(Lo+Lv)\}$, where Lo is a circumferential length at the outflow end of the discharge port, ho is a reference lift amount of the valve body, and Lv is a circumferential length of a valve head, the valve head being a portion of the valve body in contact with the outflow end of the discharge port, a ratio Do/Di of the hydraulic diameter Do of the outlet flow path to the hydraulic diameter Di at the inflow end of the discharge port being 0.602 to 0.740.

2. The compressor of claim 1, wherein the valve head has a diameter dv, and a ratio dv/ho of the diameter dv of the valve head to the reference lift amount ho of the valve body is 3.5 to 5.2.

3. The compressor of claim 1, wherein a maximum number of revolutions of the compressor is 118 rps or more.

4. The compressor of claim 2, wherein a maximum number of revolutions of the compressor is 118 rps or more.

5. A refrigeration apparatus including the compressor of claim 1.

6. A refrigeration apparatus including the compressor of claim 2.

7. A refrigeration apparatus including the compressor of claim 3.

8. A refrigeration apparatus including the compressor of claim 4.

* * * * *